US010072898B2

(12) United States Patent
Honma et al.

(10) Patent No.: US 10,072,898 B2
(45) Date of Patent: Sep. 11, 2018

(54) FIN TUBE HEAT EXCHANGER

(71) Applicant: Panasonic Intellectual Property Management Co., Ltd., Osaka (JP)

(72) Inventors: Masaya Honma, Saitama (JP); Yoshikimi Tatsumu, Osaka (JP); Osamu Ogawa, Saitama (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 323 days.

(21) Appl. No.: 14/883,401

(22) Filed: Oct. 14, 2015

(65) Prior Publication Data

US 2016/0123681 A1 May 5, 2016

(30) Foreign Application Priority Data

Nov. 4, 2014 (JP) ..... 2014-224120

(51) Int. Cl.
*F28F 1/12* (2006.01)
*F28F 1/32* (2006.01)

(52) U.S. Cl.
CPC ..... *F28F 1/12* (2013.01); *F28F 1/32* (2013.01); *F28F 2265/14* (2013.01)

(58) Field of Classification Search
CPC ..... F28D 1/00; F28D 1/02; F28D 1/04; F28F 1/00; F28F 1/02; F28F 1/04; F28F 1/10;
(Continued)

(56) References Cited

U.S. PATENT DOCUMENTS 4,691,768 A * 9/1987 Obosu ..... F28F 1/325 165/151
4,705,105 A * 11/1987 Cur ..... F28F 1/325 165/151
(Continued)

FOREIGN PATENT DOCUMENTS

EP 2767791 8/2014
EP 2767791 A1 * 8/2014 ..... F28D 1/0477
(Continued)

OTHER PUBLICATIONS

The Extended European Search Report dated Mar. 4, 2016 for the related European Patent Application No. 15190357.2.

*Primary Examiner* — Keith Raymond
*Assistant Examiner* — Gustavo Hincapie Serna
(74) *Attorney, Agent, or Firm* — McDermott Will & Emery LLP

(57) ABSTRACT

A fin satisfies $0°<\theta 2<\tan^{-1}[(L\pm\alpha)/\{(S1-D1)/2-L/\tan\theta 1\}]$, where S1 is a distance between an upstream end and a downstream end of a first inclined portion, D1 is a distance between an upstream end and a downstream end of a flat portion, θ1 is an angle between a reference plane and the first inclined portion in the flow direction, θ2 is an angle between the reference plane and the second inclined portion in the flow direction, α is a distance between the reference plane and the flat portion, and L is a distance between the reference planes of the fins adjacent to each other. θ2 gradually decreases as a measurement direction of the angle is shifted from the row direction to the air flow direction and is minimum when the measurement direction is orientated in the air flow direction.

2 Claims, 17 Drawing Sheets

(58) Field of Classification Search
CPC ..... F28F 1/12; F28F 1/20; F28F 1/30; F28F 1/32; F28F 2265/14
USPC ..... 165/148, 151, 152, 153, 177, 181, 182
See application file for complete search history.

(56) References Cited

U.S. PATENT DOCUMENTS 4,923,002 A * 5/1990 Haussmann ..... F28F 1/32 165/151
5,056,594 A * 10/1991 Kraay ..... F28F 1/325 165/151
5,109,919 A * 5/1992 Sakuma ..... F28F 1/325 165/151
5,203,403 A * 4/1993 Yokoyama ..... F28F 1/32 165/151
5,207,270 A * 5/1993 Yokoyama ..... F28F 1/325 165/151
5,722,485 A * 3/1998 Love ..... F28F 1/325 165/151
5,752,567 A * 5/1998 Obosu ..... F28F 1/325 165/151
5,927,393 A * 7/1999 Richter ..... F28F 1/32 165/151
7,182,127 B2 * 2/2007 Oh ..... F28F 1/32 165/151
7,261,147 B2 * 8/2007 Oh ..... F28D 1/0477 165/151
2004/0050539 A1 * 3/2004 Bemisderfer ..... F28D 1/0477 165/151
2005/0056407 A1 * 3/2005 Oh ..... F28F 1/32 165/151
2007/0240865 A1 * 10/2007 Zhang ..... F28D 1/0341 165/152
2012/0175101 A1 7/2012 Tamura et al.
2016/0054065 A1 2/2016 Nagai et al.

FOREIGN PATENT DOCUMENTS

JP 2013-221682 10/2013
WO 2014/167845 10/2014

* cited by examiner

FIG. 13

FIN SPECIFICATION

| | | FIN 132 | FIN 32 |
|---|---|---|---|
| HEAT TRANSFER TUBE ROW NUMBER | | 3 | 3 |
| PEAK PORTION NUMBER | | 1 | 1 |
| FIN WIDTH | mm | 18.19 | 18.19 |
| FIN PITCH | mm | 1.41 | 1.41 |
| FIN THICKNESS | mm | 0.09 | 0.09 |
| HEAT TRANSFER TUBE PITCH | mm | 21 | 21 |
| HEAT TRANSFER TUBE OUTER DIAMETER | mm | 7.3 | 7.3 |
| INCLINATION ANGLE OF FIRST INCLINED PORTION 36a, 36b | ° | 12.2 | 12.2 |
| INCLINATION ANGLE OF SECOND INCLINED PORTION 38 | ° | 25 | 0 — 25 |

FIG. 14A

PHYSICAL PROPERTIES

| AREA | MATERIAL | DENSITY [kg/m$^3$] | HEAT-TRANSFER COEFFICIENT [W/mK] | SPECIFIC HEAT [J/kgK] | COEFFICIENT OF VISCOSITY [pas] |
|---|---|---|---|---|---|
| FLUID | AIR | TEMPERATURE DEPENDENCE* | 0.0242 | 1006.43 | 1.7894E-05 |
| HEAT TRANSFER TUBE | COPPER | 8978 | 387.6 | 381 | |
| FIN | ALUMINUM | 2719 | 230 | 871 | |

*EQUATION FOR TEMPERATURE DEPENDENCE OF DENSITY: $\rho = -0.00422T + 2.426313$ [T:K]

FIG. 14B

BOUNDARY CONDITION

| | | |
|---|---|---|
| INFLOW CONDITION | TEMPERATURE [°C] | 35 |
| | DENSITY [kg/m$^3$] | 1.12592 |
| | FLOW RATE [m/s] | 1.0, 2.0 |
| OUTFLOW CONDITION | PRESSURE | ATMOSPHERIC PRESSURE |
| PIPE INNER WALL | REFRIGERANT TEMPERATURE [°C] | 42 |
| | HEAT TRANSFER COEFFICIENT [W/m2K] | 3200 |

FIG. 14C

ANALYSIS SETTING

| | | |
|---|---|---|
| MODEL | DIMENSION | THREE DIMENSIONS |
| | TIME | STATIONARY |
| | TURBULENCE MODEL | NOT CONSIDERED |
| | HEAT CALCULATION | CONSIDERED |

FIN TUBE HEAT EXCHANGER

BACKGROUND

1. Technical Field

The present disclosure relates to a fin tube heat exchanger used in a heat pump.

2. Description of the Related Art

Heat pumps typically include a compressor, a condenser, a decompressor, and an evaporator, which are connected in this sequence in a refrigerant circuit. The condenser and the evaporator may be fin tube heat exchangers. In such a case, the condenser and the evaporator each include a plurality of fins arranged at a predetermined interval and a heat transfer tube extending through the fins. Air flowing between the fins exchanges heat with a fluid flowing in the heat transfer tube.

Japanese Unexamined Patent Application Publication No. 2013-221682 discloses a fin of a fin tube heat exchanger. The fin has only one peak portion when viewed in an air flow direction. FIG. 1 is a plan view illustrating the fin.

In FIG. 1, an arrangement direction of the fins 31 is defined as a height direction Y, a direction parallel to a front edge 30*a* is defined as a row direction Z, and a direction perpendicular to both the height direction Y and the row direction Z is defined as an air flow direction X (flow direction of air A).

In FIG. 1, a ridge of a peak portion 34 extends in the row direction Z. The fin 31 is a corrugated fin. The fin 31 includes a flat portion 35, first inclined portions 36, and second inclined portions 38. The flat portion 35 is adjacent to a fin collar 37 and has a circular ring shape extending around a through hole 37*h* (see FIG. 3). The surface of the flat portion 35 extends in the air flow direction X, which is perpendicular to the height direction Y.

The first inclined portions 36 are inclined with respect to the air flow direction X so as to form the peak portion 34. The first inclined portions 36 occupy the largest area of the fin 31. The first inclined portions 36 are positioned on respective left and right sides of a reference line extending in the row direction Z through the center of a heat transfer tube 21. In other words, the first inclined portion 36 on a windward side and the first inclined portion 36 on a leeward side form the peak portion 34.

The second inclined portions 38 smoothly connect the flat portion 35 with the first inclined portions 36 so as to eliminate a difference in level between the flat portion 35 and the first inclined portions 36. The second inclined portions 38 each have a gently curved surface.

The fin 31 has only one pair of the first inclined portions 36 in the air flow direction X. The first and second inclined portions 36 and 38 monotonically increase in height toward a positive side (in a protrusion direction of the fin collar 37 in which the fin collar 37 protrudes from the flat portion 35 in the height direction Y) as a distance from a central plan Hc increases. This configuration reduces pressure loss of the airflow, and thus clogging due to frost is reduced.

SUMMARY

However, in the fin 31 disclosed in Japanese Unexamined Patent Application Publication No. 2013-221682, the first inclined portions 36 and the second inclined portions 38 form an undulating shape, which leads to separation of the airflow. Thus, frost accumulates on certain positions of the fin during operation at low outdoor temperatures. As a result, the heat transfer performance is deteriorated by the frost, and thus the performance of the heat pump is deteriorated and the effective operation time of the heat pump is shortened.

One non-limiting and exemplary embodiment provides a fin tube heat exchanger that does not deteriorate the performance of a heat pump and does not reduce the effective operation time of the heat pump.

In one general aspect, the techniques disclosed here feature a fin tube heat exchanger including a plurality of fins arranged parallel to each other to define passages of a gaseous fluid, and a heat transfer tube extending through the plurality of fins and allowing a medium that exchanges heat with the gaseous fluid to flow therethrough. Each of the plurality of fins is a corrugated fin that has only one peak portion in an air flow direction. The plurality of fins each include a plurality of through holes to which the heat transfer tube is fitted, a cylindrical fin collar disposed to extend around each of the through holes while being in close contact with the heat transfer tube, a flat portion extending around the fin collar, a first inclined portion inclined with respect to the air flow direction so as to form the peak portion, and a second inclined portion connecting the flat portion and the first inclined portion. The plurality of through holes are arranged in a row direction which is perpendicular to both an arrangement direction of the plurality of fins and the air flow direction. The plurality of fins each satisfy a relation below if the flat portion is positioned closer than a reference plane to a top of the peak portion or is positioned to satisfy $\alpha=0$, in which the reference plane is an imaginary plane in contact with a surface of each of an upstream end and a downstream end in the air flow direction of the first inclined portion that is opposite a surface thereof adjacent to the top of the peak portion and a is a distance between the reference plane and the flat portion, $$0° \leq \theta 2 < \tan^{-1}[(L-\alpha)/\{(S1-D1)/2-L/\tan\theta 1\}]$$

where S1 is a distance between the upstream end and the downstream end of the first inclined portion in the air flow direction, D1 is a distance between an upstream end and a downstream end of the flat portion in the air flow direction, θ1 is an angle between the reference plane and the first inclined portion in the air flow direction, θ2 is an angle between the reference plane and the second inclined portion in the air flow direction, and L is a distance between adjacent two of the plurality of fins in the arrangement direction of the plurality of fins. The plurality of fins each satisfy a relation below if the flat portion is positioned further than the reference plane from the top of the peak portion, $$0° < \theta 2 < \tan^{-1}[(L+\alpha)/\{(S1-D1)/2-L/\tan\theta 1\}]$$

The angle between the reference plane and the second inclined portion gradually decreases as a measurement direction of the angle is shifted from the row direction to the air flow direction and is minimum when the measurement direction is oriented in the air flow direction.

The present disclosure reduces deterioration in the performance of the heat pump and reduces reduction in the effective operation time of the heat pump.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

BRIEF DESCRIPTION OF THE DRAWINGS

FIG. 13 is a table indicating specifications of the fin of the embodiment and the conventional fin;

FIGS. 14A, 14B, and 14C are tables indicating physical properties, boundary conditions, and analysis setting, respectively, which are analysis conditions, of the fin of the embodiment and the conventional fin;

DETAILED DESCRIPTION

Hereinafter, embodiments of the present disclosure are described with reference to the drawings. The present disclosure should not be limited by the embodiments described below.

First Embodiment

Figure 1:
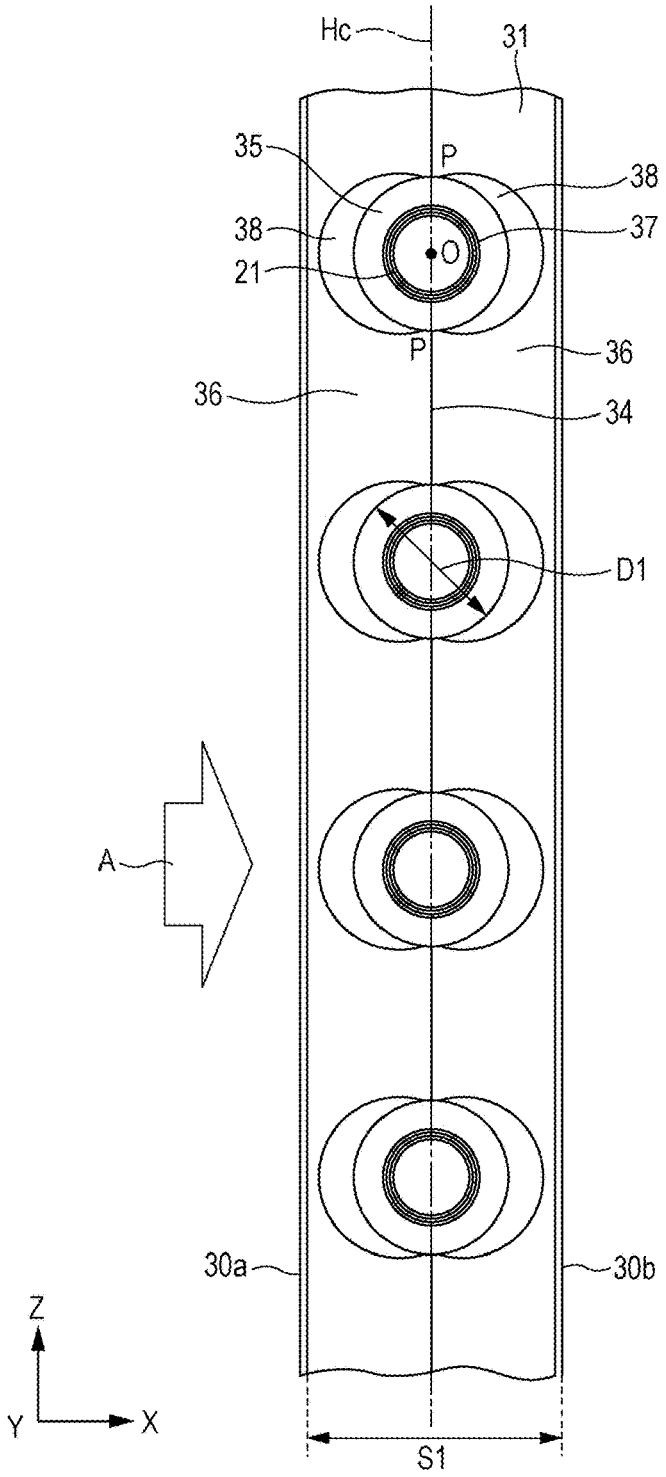
FIG. 1 is a plan view illustrating an example of a conventional fin.
Figure 2:
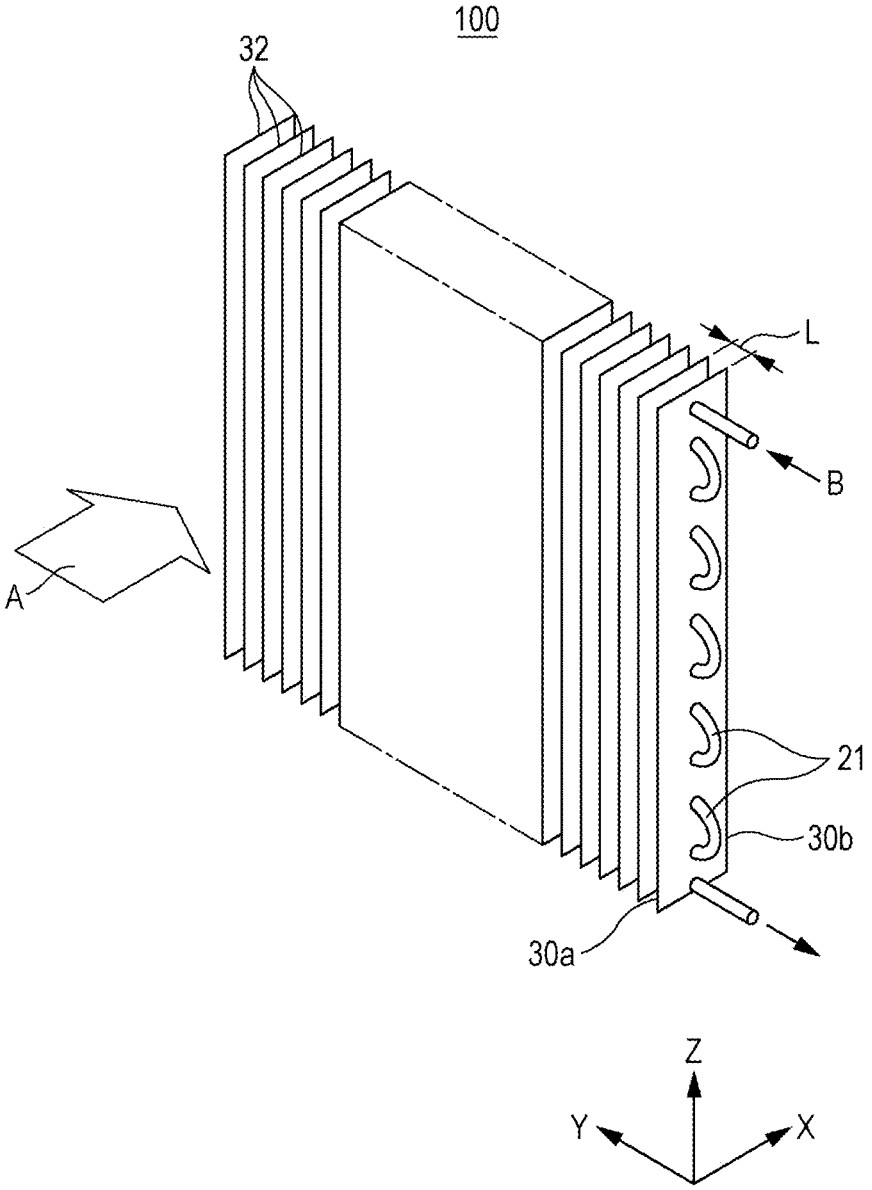
FIG. 2 is a perspective view illustrating an example of a fin tube heat exchanger of a first embodiment in the present disclosure.

FIG. 2 is a perspective view illustrating an example of a fin tube heat exchanger 100 of a first embodiment in the present disclosure. The fin tube heat exchanger 100 is typically used in a heat pump as a condenser or an evaporator. In an example described below, the heat pump including the fin tube heat exchanger 100 is used in a heater.

In this specification, as indicated in FIG. 2, a flow direction of air A is defined as an air flow direction X, an arrangement direction of fins 32 in which the fins 32 are arranged is defined as a height direction Y, and a longitudinal direction of the fin 32 is defined as a row direction Z. In other words, the row direction Z is a direction perpendicular to both the height direction Y and the air flow direction X.

As illustrated in FIG. 2, the fin tube heat exchanger 100 includes a plurality of fins 32 arranged parallel to each other to define passages for the air A (gaseous fluid) and heat transfer tubes 21 extending through the fins 32.

The fin tube heat exchanger 100 is configured such that heat exchange is caused between a medium B flowing through the heat transfer tube 21 and the air A flowing along surfaces of the fins 32. The medium B is a refrigerant such as carbon dioxide or a hydrofluorocarbon. The heat transfer tube 21 may be one continuous tube or may include a plurality of tubes.

The fins 32 each have a rectangular planar shape and have a front edge 30*a* and a rear edge 30*b*. The front edge 30*a* and the rear edge 30*b* each extend linearly. In the embodiment, the fin 32 is bilaterally and vertically symmetrical about the center of the heat transfer tube 21. Thus, the fin tube heat exchanger 100 is readily assembled, since orientation of the fins 32 does not need to be considered.

In the embodiment, the fins 32 are arranged at a constant interval (hereinafter, referred to as a fin pitch). The fin pitch may be any value in a range of 1.0 to 2.0 mm, for example. The fin pitch, which is indicated by L in FIG. 2, is a distance between an adjacent two of the fins 32. The distance (fin pitch) L may be varied among the fins 32.

Figure 3:
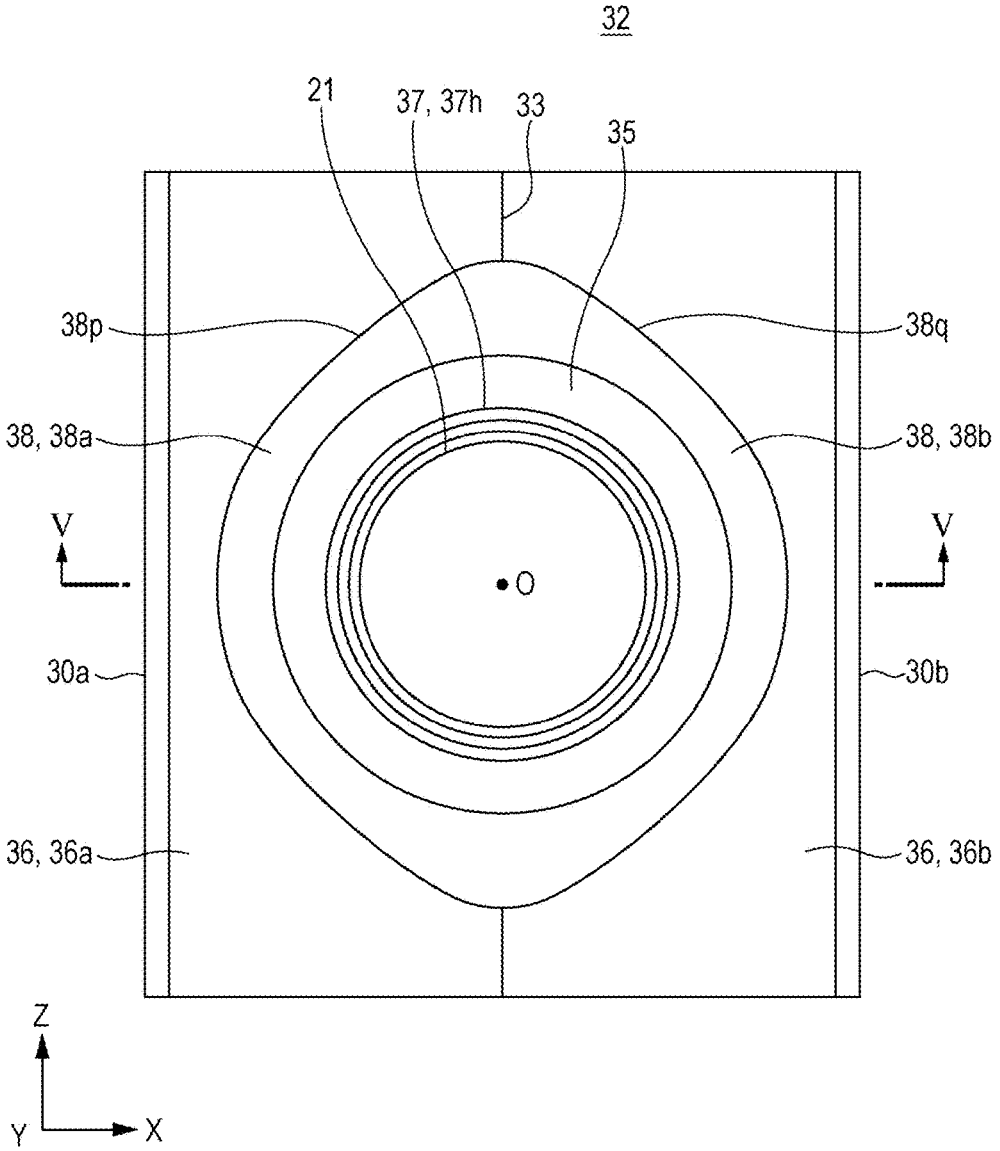
FIG. 3 is a plan view illustrating an example of a fin of the first embodiment.

FIG. 3 is a plan view illustrating an example of the fin 32 of the first embodiment. FIG. 3 illustrates a part of the fin 32, for example.

As illustrated in FIG. 3, a section including the front edge 30*a* and a section including the rear edge 30*b* each has a constant width in the air flow direction X. The sections are used to fix the fin 32 to a die during the formation of the fin 32 and have little effect on the performance of the fin 32.

A punched-out aluminum flat plate having a thickness of 0.05 to 0.8 mm is preferably used as a material of the fin 32. A hydrophilic treatment such as a boehmite treatment and an application of a hydrophilic coating material may be performed on a surface of the fin 32. Instead of the hydrophilic treatment, a water repellent treatment is performed in some cases.

The fin 32 has a plurality of through holes 37*h* arranged in a line at a constant interval in the row direction Z. The heat transfer tubes 21 are fitted in the corresponding through holes 37*h*.

The fin 32 includes cylindrical fin collars 37 extending around the corresponding through holes 37*h*. The fin collars 37 are in close contact with the heat transfer tubes 21. The through holes 37*h* each have a diameter of 1 to 10 mm, for example.

The through holes 37*h* each have a diameter equal to an outer diameter of the heat transfer tube 21. A distance between an adjacent two of the through holes 37*h* in the row direction Z (tube pitch) is two to three times longer than the diameter of the through hole 37*h*. The width of the fin 32 in the air flow direction X is 15 to 25 mm, for example.

As illustrated in FIG. 3, a peak portion 33 protrudes in a direction in which the fin collar 37 protrudes. This embodiment includes only one peak portion 33 in the air flow direction X.

The peak portion 33 has a ridge extending in the row direction Z. The fin 32 is a corrugated fin. The peak portion 33 is positioned so as to correspond to the center O of the heat transfer tube 21 in the air flow direction X.

The fin 32 further includes a flat portion 35, first inclined portions 36, and second inclined portions 38. The flat portion 35 is adjacent to the fin collar 37 and has a circular ring shape extending around the through hole 37*h*. The surface of the flat portion 35 extends in the air flow direction X, which is perpendicular to the height direction Y.

The first inclined portions 36 are inclined with respect to the air flow direction X (surface of the flat portion 35) to form the peak portion 33. The first inclined portions 36 occupy the largest area of the fin 32. The surface of each first inclined portion 36 is flat.

The first inclined portions 36 are positioned on respective left and right sides of a reference line (extending linearly in the row direction Z through the center O of the heat transfer tube 21). In the example illustrated in FIG. 3, the first inclined portion 36 on the left side of the reference line (on a windward side) is a first inclined portion 36*a* and the first inclined portion 36 on the right side of the reference line (on a leeward side) is a first inclined portion 36*b*. The first inclined portions 36*a* and 36*b* form the peak portion 33.

The second inclined portions 38 smoothly connect the flat portion 35 with the first inclined portions 36 so as to eliminate a difference in level between the flat portion 35 and the first inclined portions 36. The second inclined portions 38 each have a gently curved surface.

The second inclined portions 38 are positioned on the respective left and right sides of the reference line as the first inclined portions 36. In the example illustrated in FIG. 3, the second inclined portion 38 on the left side of the reference line (on the windward side) is a second inclined portion 38*a* and the second inclined portion 38 on the right side of the reference line (on the leeward side) is a second inclined portion 38*b*.

The second inclined portions 38 and the flat portion 35 form a recess extending around the fin collar 37 and the through hole 37*h*.

The first inclined portions 36 and the second inclined portions 38 form boundary portions 38*p* and 38*q* (inverted V-shaped portions) each including a boundary line. The boundary portion 38*p* is positioned on the left of the reference line (on the windward side or an upstream side) and the boundary portion 38*q* is positioned on the right side of the reference line (on the leeward side or a downstream side).

Figure 4:
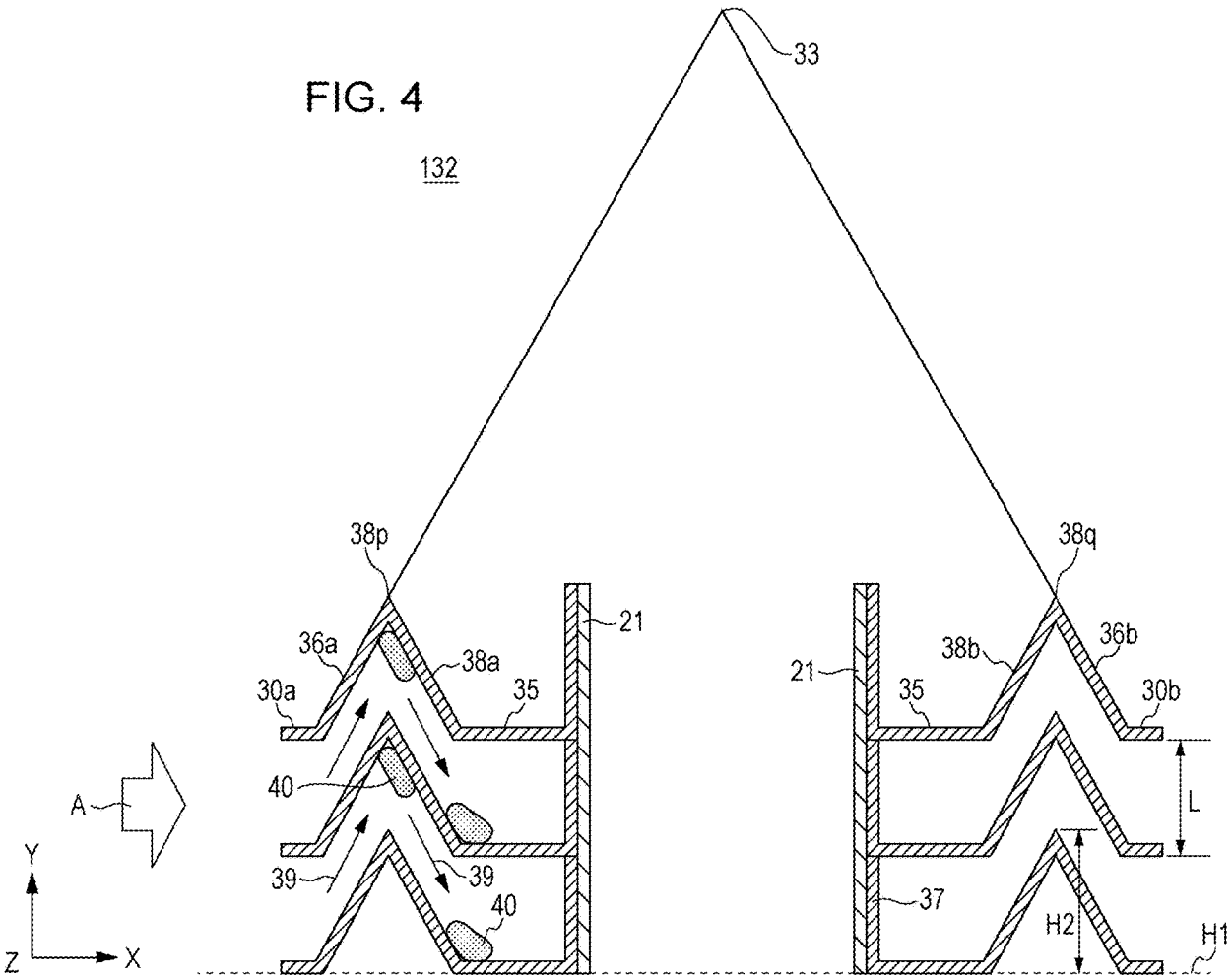
FIG. 4 is a cross-sectional view illustrating a conventional fin taken along a line corresponding to a line V-V in FIG. 3.
Figure 5:
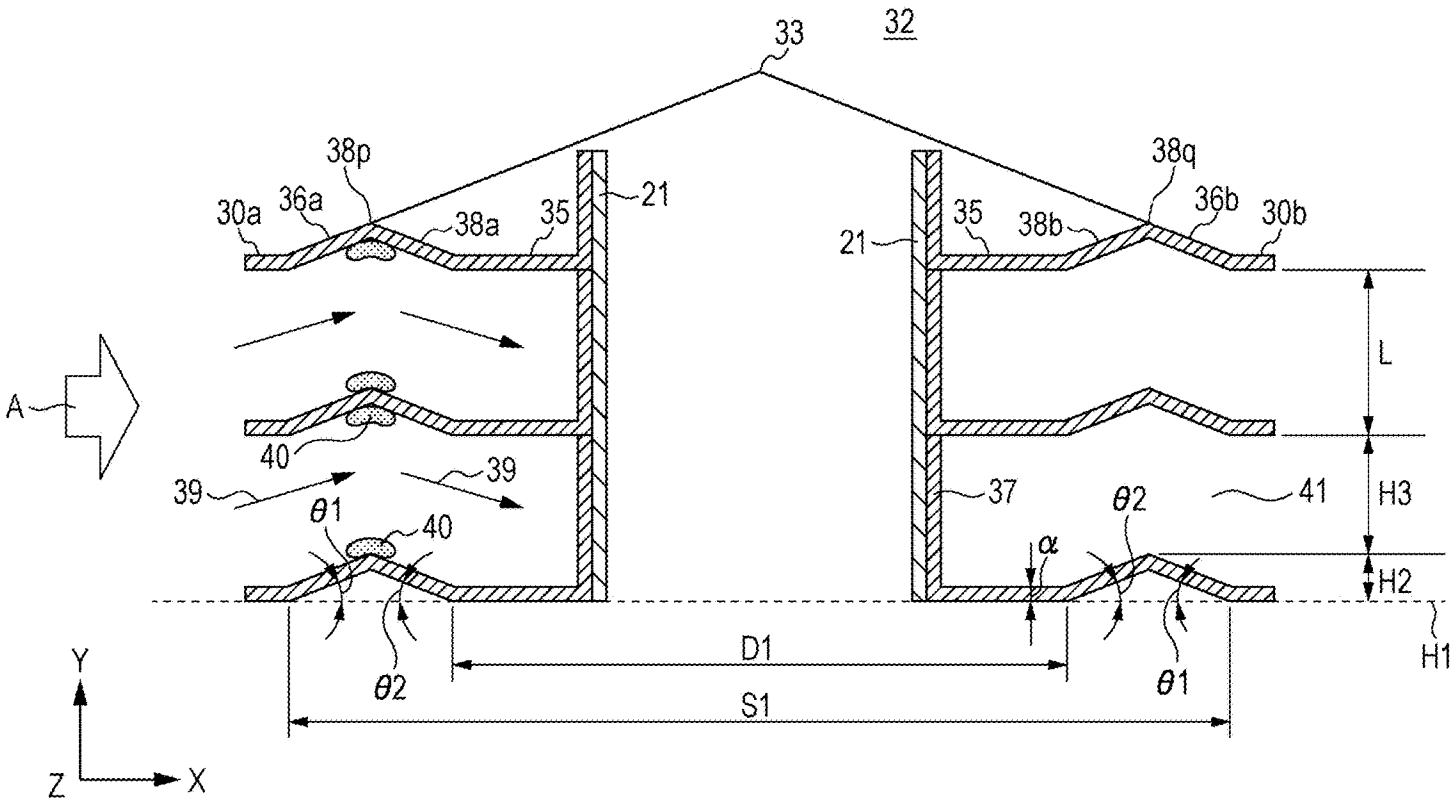
FIG. 5 is a cross sectional view illustrating the fin of the first embodiment taken along the line V-V in FIG. 3.
Figure 6:
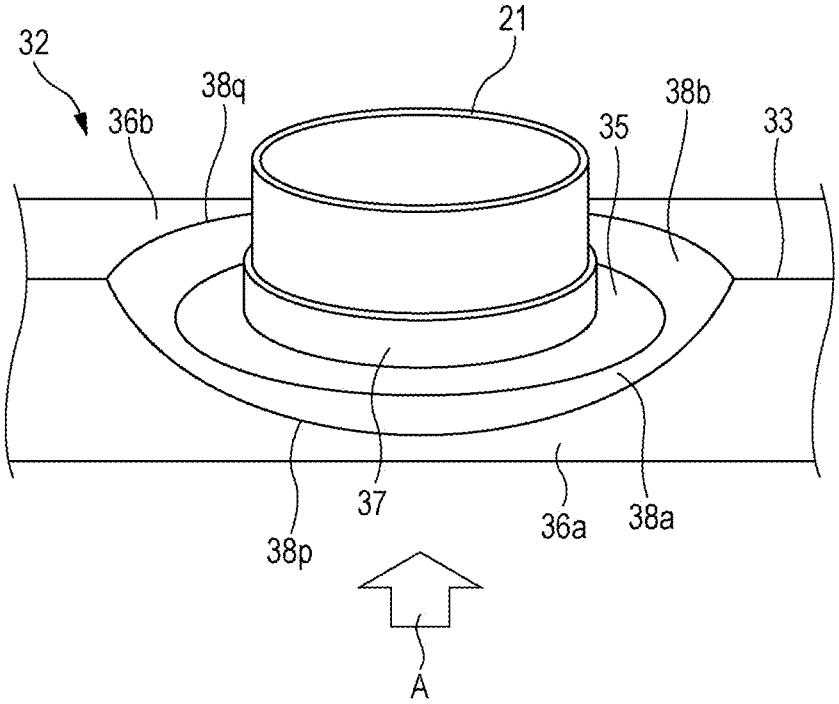
FIG. 6 is a perspective view illustrating the fin of the first embodiment.

The fin 32 of this embodiment has high heat-transfer performance, low pressure loss, and less frost formation compared with a conventional fin. Reasons for such advantages are described with reference to FIG. 4 to FIG. 6. FIG. 4 is a cross-sectional view illustrating a conventional fin 132 taken along a line corresponding to a line V-V in FIG. 3. FIG. 5 is a cross-sectional view illustrating the fin 32 of the embodiment taken along the line V-V in FIG. 3. FIG. 6 is a perspective view of the fin 32 of the embodiment.

The conventional fin 132 is described with reference to FIG. 4. In FIG. 4, an imaginary plane in contact with a surface of each of an upstream end and a downstream end, in the air flow direction X, of the first inclined portion 36 that is opposite a surface thereof adjacent to the top of the peak portion 33 is defined as a reference plane H1. A distance between the reference plane H1 of one of the fins 32 and the reference plane H1 of an adjacent one of the fins 32 adjacent to the top of the peak portion 33 (i.e., fin pitch) is defined as L. A distance between the reference plane H1 and either of the boundary portions 38*p* and 38*q* between the first inclined portions 36 and the second inclined portions 38 is defined as H2.

As illustrated in FIG. 4, the distance H2 is longer than the distance L of the conventional fin 132, and thus a folded portion (bent portion) at each of the boundary portions 38*p* and 38*q* is bent sharply, which provides no passage extending in the air flow direction X (a space 41 in FIG. 5, which is described later).

In this configuration, the air A as the airflow 39 comes into contact with the folded portion of the boundary portion 38*p* or 38*q* and does not flow smoothly along the fin 132. Thus, the airflow 39 separates at the folded portion.

The fin 132 may be used in an outdoor heat exchanger of a heat pump in a situation where the fin 132 can be frosted. In such a case, frost 40 may appear on the folded portion of the boundary portion 38*p* or 38*q* when the airflow 39 comes into contact with the folded portion as described above. This results from a high heat transfer coefficient of the folded portion.

The frost 40 accumulated on the folded portion increases thermal resistance. This leads to a sudden decrease in the heat transfer coefficient when the airflow 39 comes into contact with the folded portion. Thus, the performance of the heat exchanger decreases suddenly.

When the performance of the heat exchanger decreases, the temperature of the refrigerant of the evaporator needs to be lowered to have a difference in temperature between the refrigerant and the air in order to exhibit the function of the heat exchanger. This leads to further frost formation. The further frost formation deteriorates the performance of the heat exchanger due to a decrease in the amount of air, deteriorates the heating performance, and shortens the effective time of the heating operation.

The fin 32 of the present embodiment is described with reference to FIG. 5 and FIG. 6. In FIG. 5, the reference plane H1, the distance L, and the distance H2, which have the same definitions as those in FIG. 4, are indicated. In FIG. 5, an angle between the reference plane H1 and each of the first inclined portions 36*a* and 36*b* in the air flow direction X is defined as θ1. An angle between the reference plane H1 and each of the second inclined portions 38*a* and 38*b* in the air flow direction X is defined as θ2. A distance between an upstream end and a downstream end of the first inclined portion 36 in the air flow direction X is defined as S1. The diameter of the flat portion 35 is defined as D1. A distance between the reference plane H1 to the flat portion 35 is defined as α.

The flat portion 35 may be positioned above or below the reference plane H1. The height position of the flat portion 35 may be the same as the height position of the reference plane H1. In such a case, a is zero.

As illustrated in FIG. 5, the distance H2 is shorter than the distance L in the fin 32 of the embodiment. This allows the folded portions at the boundary portions 38*p* and 38*q* to curve gently, and thus there is a space 41, i.e., a passage extending in the air flow direction X.

The space 41 is provided between the boundary portion 38*p* or 38*q* of one of the fins 32 and the reference plane H1 of an adjacent one of the fins 32 adjacent to the top of the peak portion 33. A distance H3 is a distance between the boundary portion 38*p* or 38*q* of one of the fins 32 and the reference plane H1 of an adjacent one of the fins 32 adjacent to the top of the peak portion 33.

As described above, the space 41 is provided in the case where the distance H2 is shorter than the distance L. Conditions for obtaining the space 41 are described below.

The distance H2 is represented by the following equation:

$$H2=\{(S1-D1)/2\pm\alpha/\tan\theta2\}/(1/\tan\theta1+1/\tan\theta2)$$

If the distance L is equal to the distance H2, the distance L is represented by the flowing equation:

$$L=\{(S1-D1)/2\pm\alpha/\tan\theta2\}/(1/\tan\theta1+1/\tan\theta2)$$

A tangent of the angle θ2 is represented by the following equation:

$$\tan\theta2=(L\pm\alpha)/\{(S1-D1)/2-L/\tan\theta1\}$$

A threshold angle of θ2U, which is an upper limit of the angle θ2, i.e., at which the distance H2 is equal to the distance L, is represented by the following equation (1):

$$\theta2U=\tan^{-1}[(L\pm\alpha)/\{(S1-D1)/2-L/\tan\theta1\}] \quad (1)$$

The fin 32 of the embodiment is configured to satisfy the equation (1).

In the case where the flat portion 35 is positioned closer than the reference plane H1 to the top of the peak portion 33 or is positioned to satisfy $\alpha=0$, for example, the fin 32 of the embodiment satisfies the following equation:

$$0° \leq \theta 2 < \tan^{-1}[(L-\alpha)/\{(S1-D1)/2-L/\tan\theta 1\}]$$

In the case where the flat portion 35 is positioned further than the reference plane H1 from the top of the peak portion 33, the fin 32 of the present embodiment satisfies the following equation:

$$0° < \theta 2 < \tan^{-1}[(L+\alpha)/\{(S1-D1)/2-L/\tan\theta 1\}]$$

In the above, two relations to be satisfied by the fin 32 of the embodiment are described by using a representing the distance between the reference plane H1 and the flat portion 35. One of the relations is for the case where the flat portion 35 is positioned closer than the reference plane H1 to the top of the peak portion 33 or is positioned to satisfy $\alpha=0$. The other of the relations is for the case where the flat portion 35 is positioned further than the reference plane H1 from the top of the peak portion 33. However, $\beta$ may be used instead of $\alpha$. In such a case, the fin 32 of the embodiment satisfies the following equation:

$$0° \leq \theta 2 < \tan^{-1}[(L-\beta)/\{(S1-D1)/2-L/\tan\theta 1\}]$$

where $\beta$ represents a coordinate of intersection between an imaginary extension plane of the flat portion 35 and a coordinate axis. The coordinate axis extends in the Y direction and has an origin at a point of intersection between an imaginary extension plane of the reference plane H1 and the coordinate axis. A positive side of the coordinate axis is on a side adjacent to the peak portion 33.

The fin 32 of the embodiment having the above configuration has at least an area where the air A as the airflow 39 flows smoothly along the fin 32 without coming into contact with the folded portions of the boundary portions 38*p* and 38*q*. Thus, the airflow 39 is unlikely to separate at the folded portions.

The fin 32 may be used in an outdoor heat exchanger of a heat pump in a situation where the fin 32 can be frosted. In such a case, since the airflow 39 flows smoothly along the fin 32 as described above, the frost 40 is uniformly formed on the fin 32 (i.e., the frost does not accumulate at certain positions).

This configuration reduces a sudden decrease in the heat transfer coefficient, which reduces a sudden decrease in the performance of the heat exchanger. This results in slow acceleration of the frost formation and reduces the deterioration in the performance of the heat exchanger, reduces the deterioration in the heating performance, and reduces the reduction in the effective time of the heating operation.

As illustrate in FIG. 6, in the fin 32 of this embodiment, the angle between the reference plane H1 and the second inclined portion 38*a* or 38*b* gradually decreases as a measurement direction of the angle is shifted from the row direction Z to the air flow direction X and is the minimum value (angle $\theta 2$) when the measurement direction is oriented in the air flow direction X.

This configuration enables the distance H3 of the space 41 to be longer, and thus the airflow 39 comes into direct contact with the fin collar 37 over a wider area. In addition, the airflow 39 flows along the flat portion 35 positioned around the heat transfer tube 21, and thus the performance of the heat exchanger is improved.

This configuration also allows the airflow 39 that has come into contact with the fin collar 37 to smoothly flow along the second inclined portions 38 positioned around the flat portion 35. Thus, a dead zone behind the fin collar 37 in the air flow direction X is reduced, which improves the performance of the heat exchanger.

Figure 7:
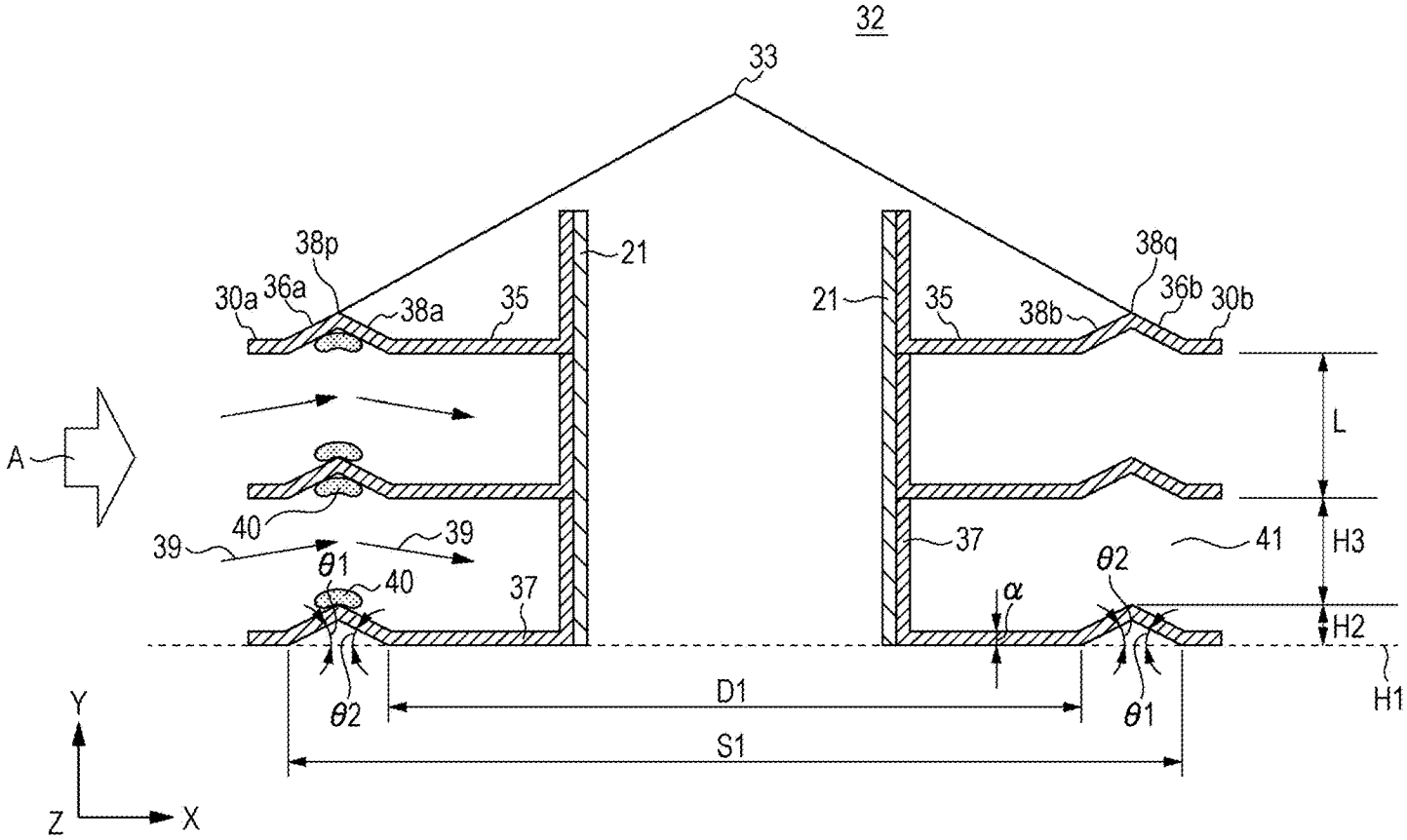
FIG. 7 is a cross sectional view illustrating a fin of a modification of the first embodiment taken along a line corresponding to the line V-V in FIG. 3.

The shape of the fin 32 of the embodiment is not limited to the shape illustrated in FIG. 5 and FIG. 6. The fin 32 may have a shape as illustrated in FIG. 7, for example. FIG. 7 is a cross-sectional view illustrating a fin 32 according to a modification of the embodiment taken along a line corresponding to the line V-V in FIG. 3.

The second inclined portions 38*a* and 38*b* in FIG. 7 each have a shorter width and the flat portion 35 in FIG. 7 has a longer length in the air flow direction X than those in FIG. 5. This increases the area of the flat portion 35 in the air flow direction X, which allows the airflow 39 to flow more smoothly along the flat portion 35. With this configuration, the frost 40 is uniformly formed on the fin 32, and thus a sudden decrease in the heat-transfer coefficient is reduced compared with the configuration in FIG. 5. As a result, a sudden decrease in the performance of the heat exchanger is reduced.

Second Embodiment

Figure 8:
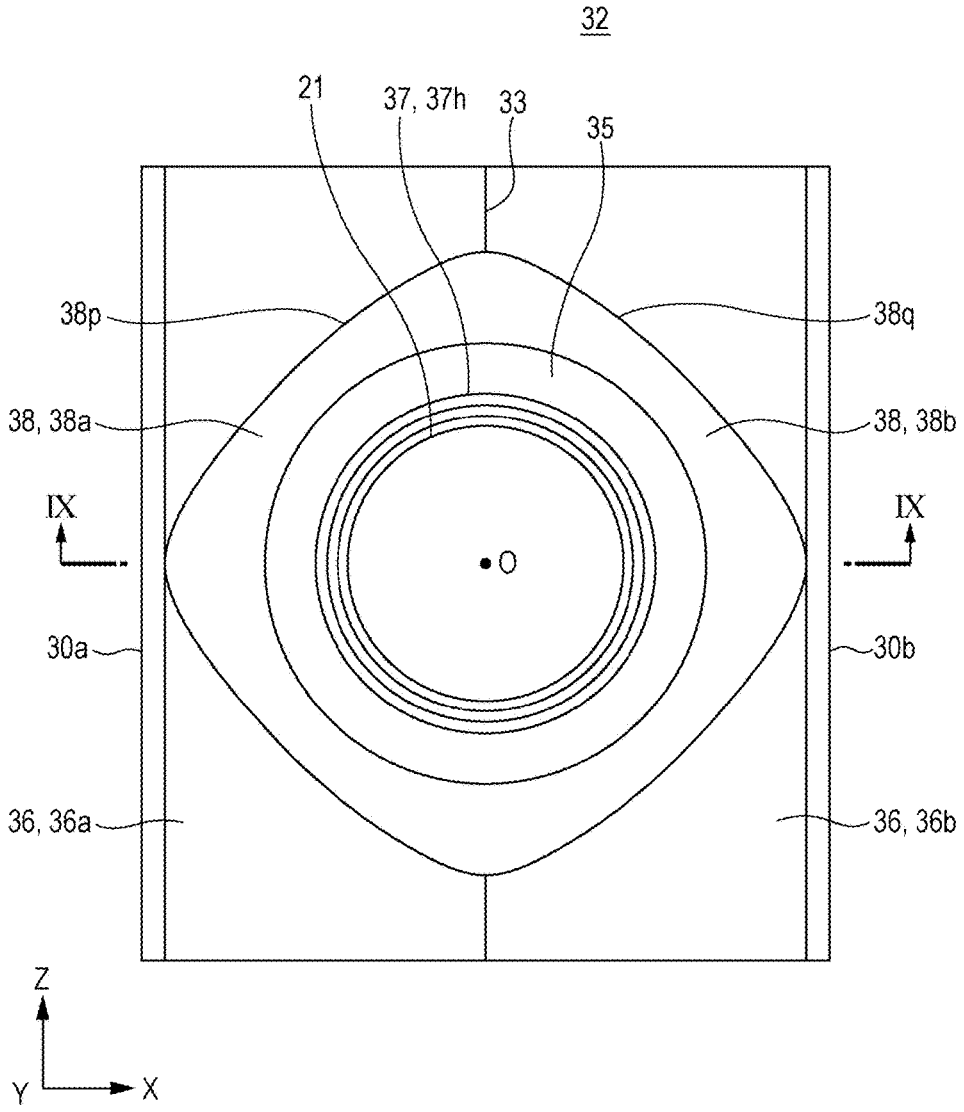
FIG. 8 is a plan view illustrating an example of a fin of a second embodiment in the present disclosure.
Figure 9:
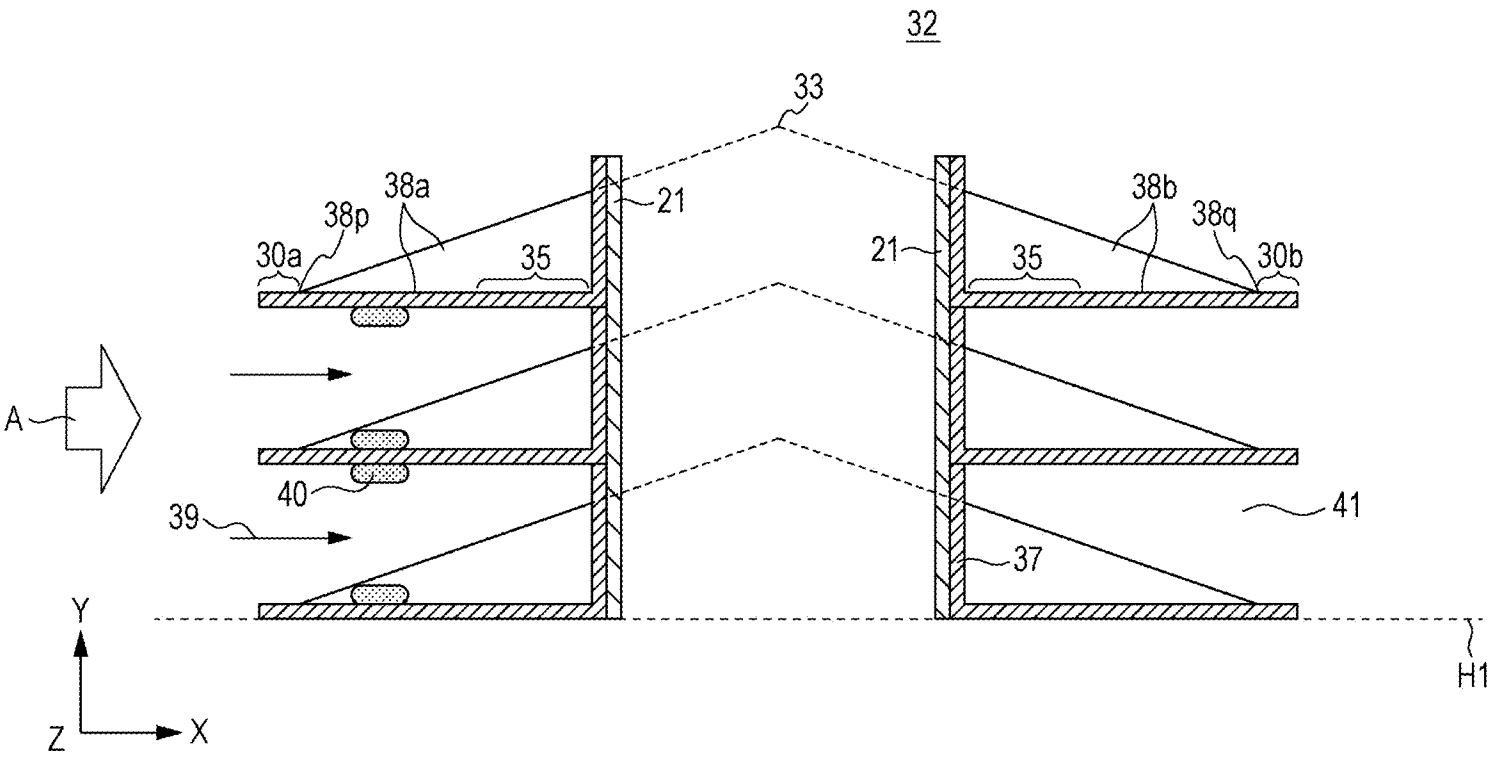
FIG. 9 is a cross-sectional view illustrating the fin of the second embodiment taken along a line IX-IX in FIG. 8.
Figure 10:
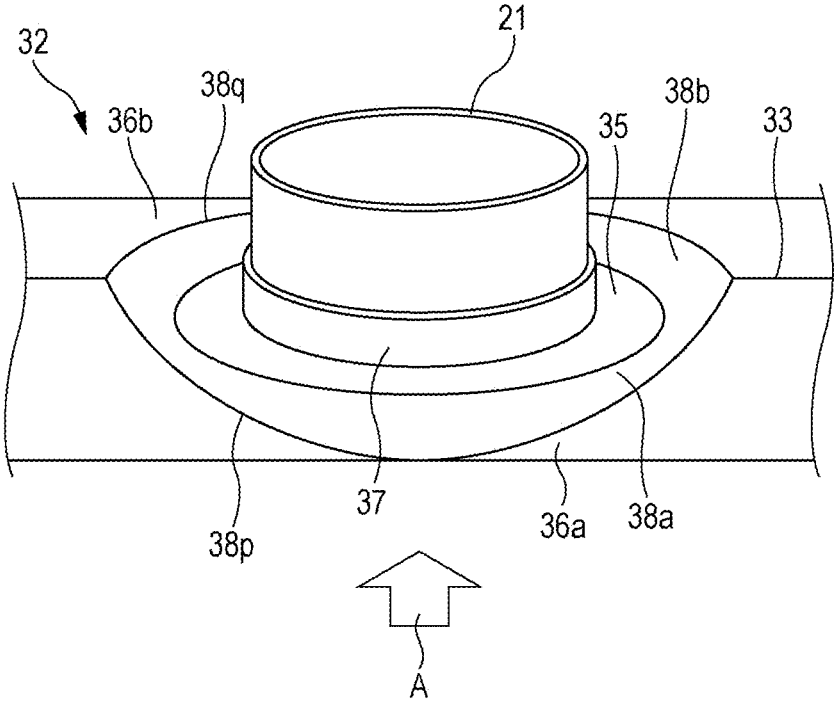
FIG. 10 is a perspective view illustrating the fin of the second embodiment.

A fin 32 of a second embodiment in the present disclosure is described with reference to FIG. 8 to FIG. 10. FIG. 8 is a plan view illustrating an example of the fin 32 of the second embodiment. FIG. 9 is a cross-sectional view illustrating the fin 32 of the second embodiment taken along a line IX-IX in FIG. 8. FIG. 10 is a perspective view of the fin 32 of the second embodiment. Components in FIG. 8 to FIG. 10 have the same reference numerals as those in the first embodiment illustrated in FIG. 3, FIG. 5, and FIG. 6. Hereinafter, components in FIG. 8 to FIG. 10 that are different from those in the first embodiment are described.

As illustrated in FIG. 8 to FIG. 10, in the fin 32 of this embodiment, a part of the boundary portion 38*p* is flush with the front edge 30*a* and a part of the boundary portion 38*q* is flush with the rear edge 30*b*. In other words, the distance H2 between each of the boundary portions 38*p* and 38*q* and the reference plane H1 is zero at some positions in the fin 32 of this embodiment.

As illustrated in FIG. 8 to FIG. 10, the fin 32 does not include the first inclined portion 36 and includes the second inclined portions 38*a* and 38*b* that are flat at the positions where the part of the boundary portion 38*p* is flush with the front edge 30*a* and the part of the boundary portion 38*q* is flush with the rear edges 30*b*. Thus, the distance H2 and the angles $\theta 1$ and $\theta 2$ are zero at the positions.

The airflow 39 readily flows along the fin 32 at the positions where the distance H2 is zero, and thus the frost 40 is uniformly formed on the fin 32.

This configuration reduces the sudden decrease in the heat transfer coefficient, which reduces the sudden deterioration in the performance of the heat exchanger. This results in slow acceleration of the frost formation and reduction in the deterioration of the performance of the heat exchanger and the reduction in the effective time of the heat operation.

In this embodiment, the airflow separation is reliably prevented at the positions where the distance H2 is zero. This reduces airflow resistance and fan power consumption.

In addition, in the fin 32 of this embodiment, the airflow 39 comes into direct contact with the fin collar 37 in a larger area. This allows the airflow 39 to readily flow along the flat portion 35 positioned around the heat transfer tube 21, which improves the performance of the heat exchanger.

In addition, this configuration allows the airflow 39 that has come into contact with the fin collar 37 to readily flow along the second inclined portion 38 positioned around the flat portion 35. Thus, the dead zone at the rear of the fin collar 37 in the air flow direction X is reduced, which improves the performance of the heat exchanger.

Figure 11:
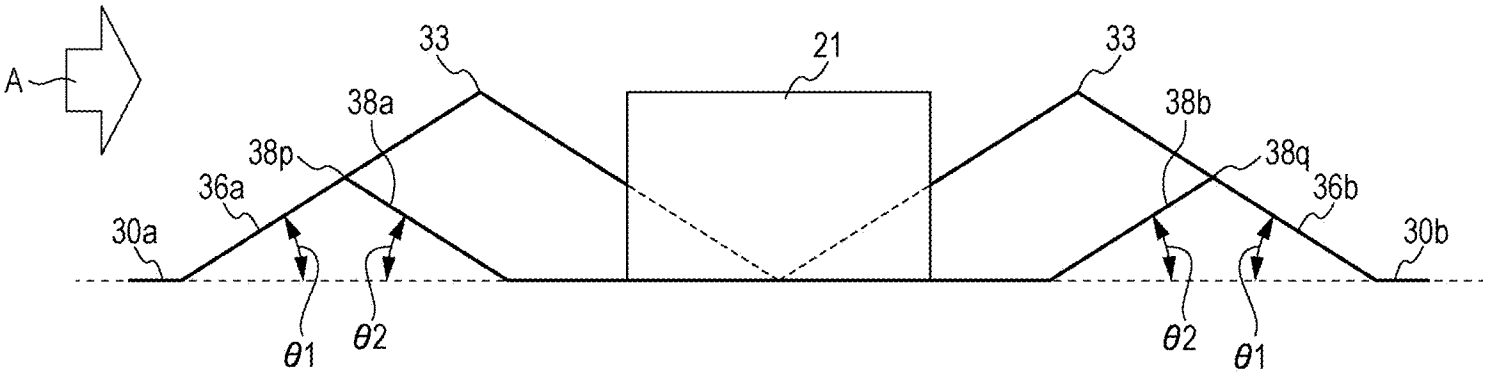
FIG. 11 is a cross-sectional view illustrating a corrugated fin having two peak portions.

The first and second embodiments in the present disclosure are described above. The fins 32 in the first and second embodiments each have one peak portion 33 as illustrated in FIG. 3, and FIG. 5 to FIG. 10. The reason why the fin 32 has one peak portion 33 is explained with reference to FIG. 11. FIG. 11 is a cross-sectional view illustrating an example of a corrugated fin having two peak portions 33.

If the angle θ2 of the corrugated fin having one peak portion 33 as described in the first and second embodiments is equal to the angle θ2 of the corrugated fin having two peak portions 33 illustrated in FIG. 11, the corrugated fin having one peak portion 33 has a smaller airflow resistance than the corrugated fin having two peak portions 33. In the corrugated fin according to the embodiments having only one peak portion 33, the air flow turns less and the resistance due to the contact with the folded portion is reduced.

In addition, the airflow separates less in the corrugated fin having one peak portion 33 than in the corrugated fin having a plurality of peak portions 33. Thus, the frost does not accumulate at certain positions in the corrugated fin having one peak portion 33, which reliably reduces the deterioration in the performance of the heat exchanger, the deterioration of the heating performance, and the reduction in the effective time of the heating operation. This is the reason why the fin 32 of the first and second embodiments in the present disclosure has only one peak portion 33.

In the first and second embodiments, the heat pump that includes the fin tube heat exchanger 100 is used in the heater. However, the heat pump that includes the fin tube heat exchanger 100 may be used in an air conditioner or a water heater, for example.

Next, a comparison between the fin according to the embodiments in the present disclosure and the conventional fin is described with reference to FIG. 12 to FIG. 16.

Figure 12A:
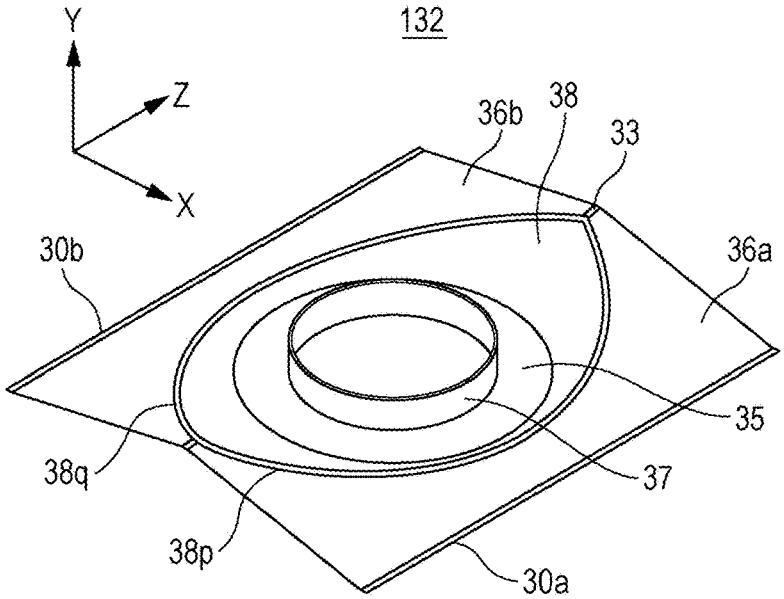
FIGS. 12A and 12B are a perspective view of the conventional fin and a perspective view of the fin of the embodiment, respectively.
Figure 12B:
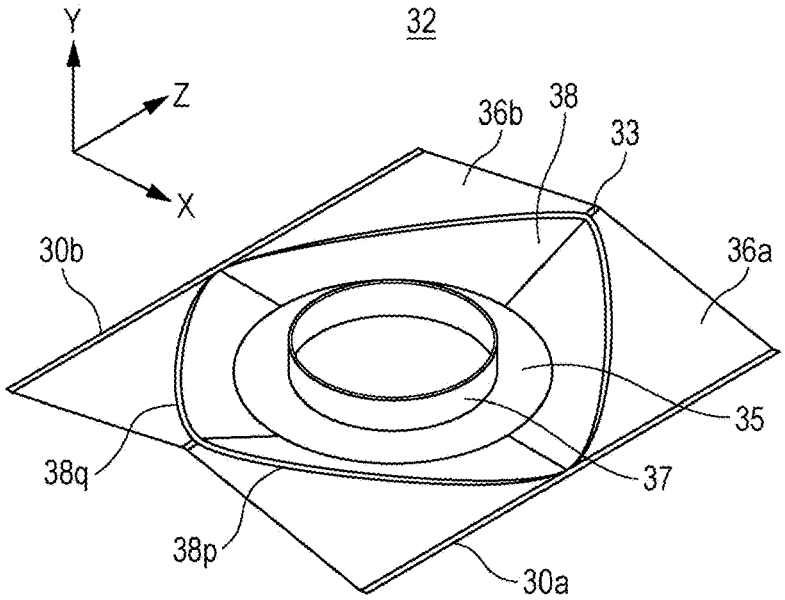

Herein, a comparison is made between a fin 132 having a conventional configuration illustrated in FIG. 12A and the fin 32 of the embodiment in the present disclosure illustrated in FIG. 12B.

The fin 32 illustrated in FIG. 12B satisfies the following relation as the fin 32 illustrated in FIG. 8.

$$0° \leq \theta 2 < \tan^{-1}[(L-\alpha)/\{(S1-D1)/2-L/\tan\theta 1\}]$$

In the fin 32 illustrated in FIG. 12B, the angle between the reference plane and the second inclined portion 38 gradually decreases as a measurement direction of the angle is shifted from the row direction Z to the air flow direction X and is zero, which is the minimum value, when the measurement direction is oriented in the air flow direction X. The reference plane is the same as the reference plane H1 described with reference to FIG. 4.

In FIGS. 12A and 12B, components that are identical to those in FIG. 8 are assigned reference numerals the same as those in FIG. 8. In FIGS. 12A and 12B, the heat transfer tube 21 in close contact with the inner surface of the fin collar 37 is not illustrated.

FIG. 13 is a table indicating specifications of the fin 132 and the fin 32. As indicated in FIG. 13, the fin 132 is equal to the fin 32 in the number of heat transfer tube rows, the number of peak portions, the fin width, the win pitch, the fin thickness, the heat transfer tube pitch, the heat transfer tube outer diameter, and the inclination angle of each of the first inclined portions 36*a* and 36*b*. The fin 132 is different from the fin 32 only in the inclination angle of the second inclined portion 38 (angle between the reference plane and the second inclined portion 38). Specifically, in the fin 132 illustrated in FIG. 12A, an angle between the reference plane and the second inclined portion 38 is a constant angle of 25°. In the fin 32 illustrated in FIG. 12B, an angle between the reference plane and the second inclined portion 38 is 25° when measured in the row direction Z and is 0° when measured in the air flow direction X.

The fins 132 and 32 are modeled in three dimensions by using thermo-fluid analysis software, which is commercially available, to perform fluid analysis simulation. A mesh used in the simulation is generated by using mesh generation software, which is commercially available. Detailed analysis conditions are indicated in FIG. 14A to FIG. 14C. FIGS. 14A, 14B, and 14C indicate physical properties, boundary conditions, and analysis setting, respectively.

Figure 15:
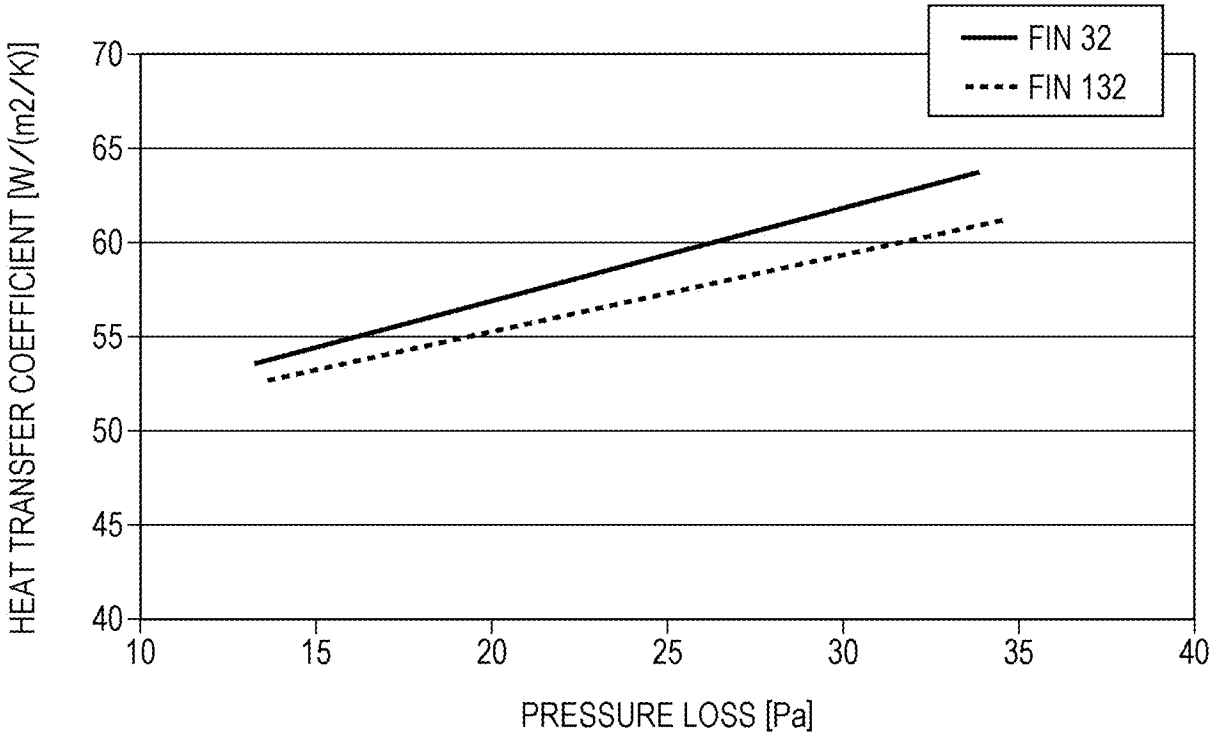
FIG. 15 is a graph indicating a relationship between a heat transfer coefficient and pressure loss, which are analysis results of the fin of the embodiment and the conventional fin.

A relationship between the heat transfer coefficient and the pressure loss obtained by the above-described analysis is indicated in FIG. 15. As indicated in FIG. 15, the fin 32 having the pressure loss equal to that of the fin 132 is higher in the heat transfer coefficient than the fin 132. The fin 32 has better heat transfer performance than the fin 132.

Figure 16A:
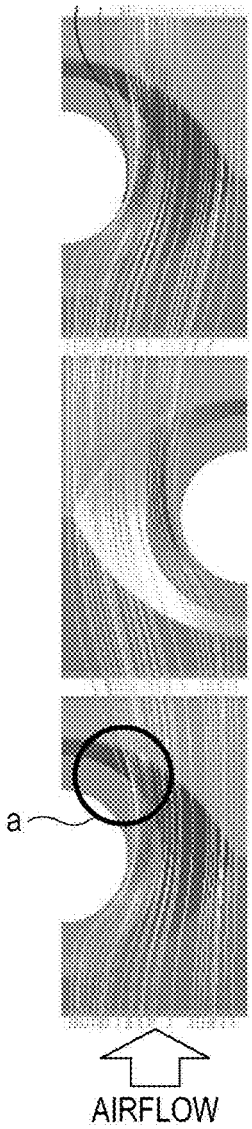
FIGS. 16A and 16B are flow line graphs, which are analysis results of each of the fin of the embodiment and the conventional fin.
Figure 16B:
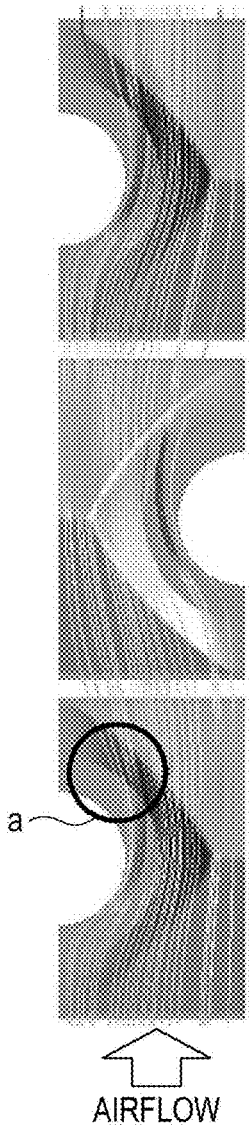

The airflow obtained by the analysis is indicated in FIGS. 16A and 16B. FIG. 16A indicates flow lines of the fin 132 and FIG. 16B indicates flow lines of the fin 32. As can be seen from the comparison between an encircled portion a in FIG. 16A and an encircled portion a in FIG. 16B, the fin 32 allows the air to readily flow to the rear of the heat transfer tube (fin collar) in the air flow direction X compared with the fin 132.

The following is another expression of the fin tube heat exchanger in the present disclosure.

The fin tube heat exchanger of the present disclosure includes:

a plurality of fins each having a plurality of through holes and defining passages of a gaseous fluid;

a heat transfer tube extending through at least one of the plurality of through holes of each of the fins and allowing a medium that exchanges heat with the gaseous fluid to pass therethrough, wherein each of the plurality of fins is a corrugated fin and includes:

a cylindrical fin collar disposed to extend around each of the through holes;

a flat portion extending around the fin collar;

a pair of first inclined portions; and a second inclined portion connecting the flat portion and the pair of first inclined portions, and the plurality of through holes are arranged in a Z direction that is perpendicular to an X direction and a Y direction, the X direction being a flow direction of the gaseous fluid, the Y direction being perpendicular to the X direction and extending in an axial direction of the plurality of through holes, the pair of first inclined portions forms only one peak portion, the plurality of fins each have a first surface and a second surface, the first surface being positioned further than the second surface from the peak portion, each of the plurality of fins satisfies a relation below if the flat portion is positioned closer than a reference plane to the peak portion or is positioned to satisfy α=0, in which the reference plane is an imaginary plane in contact with the first surface and a is a distance between the reference plane and the flat portion:

$$0° \leq \theta 2 < \tan^{-1}[(L-\alpha)/\{(S1-D1)/2-L/\tan\theta 1\}]$$

where S1 is twice a distance between a center of the heat transfer tube and a furthest position of the pair of first inclined portions from the center of the heat transfer tube in a cross section taken along a line extending through the center of the heat transfer tube, D1 is twice a distance between the center of the transfer tube and a furthest position of the second inclined portion from the center of the heat transfer tube in the cross section, θ1 is an angle between the reference plane and each of the pair of first inclined portions in the cross section, θ2 is an angle between the reference plane and the second inclined portion in the cross section, L is a distance between the reference plane of one of the plurality of fins and the reference plane of another of the plurality of fins most adjacent to the one of the plurality of fins, and each of the plurality of fins satisfies a relation below if the flat portion is positioned further than the reference plane from the peak portion:

$$0° < \theta 2 < \tan^{-1}[(L+\alpha)/\{(S1-D1)/2-L/\tan\theta 1\}]$$

θ2 gradually decreases as a plane angle becomes smaller in the cross section and θ2 is minimum when the plane angle is zero, the plane angle being an angle between a line extending in the X direction through the center of the heat transfer tube and the cross section when one of the plurality of fins is viewed in the Y direction.

The following is a further another expression of the fin tube heat exchanger of the present disclosure.

A fin tube heat exchanger of the present disclosure includes:

a plurality of fins each having a plurality of through holes and defining passages of a gaseous fluid; and a heat transfer tube extending through one of the through holes of each of the plurality of fins and allowing a medium that exchanges heat with the gaseous fluid therethrough, wherein each of the plurality of fins is a corrugated fin and includes:

a cylindrical fin collar disposed to extend around each of the through holes;

a flat portion extending around the fin collar;

a pair of first inclined portions; and a second inclined portion connecting the flat portion and the pair of first inclined portions, the plurality of through holes are arranged in a Z direction which is perpendicular to an X direction and a Y direction, the X direction being orientated in a flow direction of the gaseous fluid, the Y direction being perpendicular to the X direction and extending in an axial direction of the plurality of through holes, the pair of first inclined portions forms only one peak portion, each of the plurality of fins has a first surface and a second surface, the first surface being positioned further than the second surface from the peak portion, a reference plane is an imaginary plane in contact with the first surface, the second inclined portion does not intersect with the reference plane positioned adjacent to the second inclined portion in a cross section taken along a line extending through the center of the heat transfer tube, and θ2 gradually decreases as a plane angle becomes smaller in the cross section and is minimum at the plane angle of 0, where θ2 is an angle between the reference plane and the second inclined portion in the cross section, the plane angle being an angle between a line extending in the X direction through a center of the heat transfer tube and the cross section when viewed in the Y direction.

The fin tube heat exchanger according to the present disclosure is advantageously applicable to a heat pump used in an air conditioner, a water heater, or a heater, for example, and particularly to an evaporator that evaporates a refrigerant.

What is claimed is:

1. A fin tube heat exchanger comprising:

a plurality of fins arranged parallel to each other to define passages of a gaseous fluid; and a heat transfer tube extending through the plurality of fins and allowing a medium that exchanges heat with the gaseous fluid to flow therethrough, wherein each of the plurality of fins is a corrugated fin that has only one peak portion when viewed in an air flow direction, the plurality of fins each includes:

a plurality of through holes to which the heat transfer tube is fitted;

a cylindrical fin collar disposed to extend around each of the through holes while being in close contact with the heat transfer tube;

a flat portion extending around the fin collar;

a first inclined portion inclined with respect to the air flow direction so as to form the peak portion; and a second inclined portion connecting the flat portion and the first inclined portion, the plurality of through holes are arranged in a row direction which is perpendicular to both an arrangement direction of the plurality of fins and the air flow direction, the plurality of fins each satisfy a relation below if the flat portion is positioned closer than a reference plane to a top of the peak portion or is positioned to satisfy α=0, in which the reference plane is a plane in contact with a surface of each of an upstream end and a downstream end in the air flow direction of the first inclined portion that is opposite a surface thereof adjacent to the top of the peak portion and α is a distance between the reference plane and the flat portion, $$0° \geq \theta 2 < \tan^{-1}[(L-\alpha)/\{(S1-D1)/2-L/\tan\theta 1\}]$$

where S1 is a distance between the upstream end and the downstream end of the first inclined portion in the air flow direction, D1 is a distance between an upstream end and a downstream end of the flat portion in the air flow direction, θ1 is an angle between the reference plane and the first inclined portion in the air flow direction, θ2 is an angle between the reference plane and the second inclined portion in the air flow direction, and L is a distance between the reference plane of one of the plurality of fins and the reference plane of an adjacent one of the plurality of fins adjacent to the top of the peak portion, and the plurality of fins each satisfy a relation below if the flat portion is positioned further than the reference plane from the top of the peak portion, $$0° < \theta 2 < \tan^{-1}[(L+\alpha)/\{(S1-D1)/2-L/\tan\theta 1\}]$$

the angle between the reference plane and the second inclined portion gradually decreases as a measurement direction of the angle is shifted from the row direction to the air flow direction and is minimum when the measurement direction is oriented in the air flow direction.

2. The fin tube heat exchanger according to claim 1, wherein θ2 is zero.

* * * * *